US010076906B2

(12) United States Patent
Nakamura

(10) Patent No.: US 10,076,906 B2
(45) Date of Patent: Sep. 18, 2018

(54) LIQUID DISCHARGE HEAD AND METHOD FOR MANUFACTURING SAME

(71) Applicant: CANON KABUSHIKI KAISHA, Tokyo (JP)

(72) Inventor: Yohei Nakamura, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/835,557

(22) Filed: Aug. 25, 2015

(65) Prior Publication Data

US 2016/0059559 A1 Mar. 3, 2016

(30) Foreign Application Priority Data

Aug. 29, 2014 (JP) ..... 2014-175515

(51) Int. Cl.
*B41J 2/45* (2006.01)
*B41J 2/14* (2006.01)
*B41J 2/16* (2006.01)

(52) U.S. Cl.
CPC ..... *B41J 2/14233* (2013.01); *B41J 2/161* (2013.01); *B41J 2/1626* (2013.01); *B41J 2/1631* (2013.01); *B41J 2002/14491* (2013.01); *B41J 2202/12* (2013.01)

(58) Field of Classification Search
CPC combination set(s) only.
See application file for complete search history.

(56) References Cited

U.S. PATENT DOCUMENTS 5,956,058 A * 9/1999 Momose ..... B41J 2/14274 347/71
7,637,599 B2 * 12/2009 Ota ..... B41J 2/14233 347/68

(Continued)

FOREIGN PATENT DOCUMENTS

JP 2001-287363 A 2/2005
JP 2005-034849 A 2/2005

(Continued)

*Primary Examiner* — Matthew Luu
*Assistant Examiner* — Tracey McMillion
(74) *Attorney, Agent, or Firm* — Canon U.S.A., Inc. IP Division

(57) ABSTRACT

A liquid discharge head includes an element substrate, a liquid supply substrate, a photosensitive resin layer with which the element substrate and the liquid supply substrate are adhered, and a liquid inflow through-hole penetrating the element substrate, the photosensitive resin layer, and the liquid supply substrate. The element substrate includes a pressure chamber including a discharge opening that discharges liquid, a liquid supply passage, in which one end is connected to the pressure chamber and another end is connected to the liquid inflow through-hole, the liquid supply passage supplying the liquid supplied from the liquid inflow through-hole to the pressure chamber, a diaphragm that forms a surface that opposes the discharge opening of the pressure chamber, a piezoelectric transducer that applies vibration to the diaphragm, and a partition portion, in which one surface opposes the liquid supply passage and another surface opposes the photosensitive resin layer through the diaphragm.

5 Claims, 17 Drawing Sheets

(56) References Cited

U.S. PATENT DOCUMENTS

| | | | | |
|---|---|---|---|---|
| 2003/0214564 | A1* | 11/2003 | Miyata | B41J 2/14233 347/72 |
| 2004/0001122 | A1* | 1/2004 | Miyata | B41J 2/14233 347/68 |
| 2008/0062225 | A1* | 3/2008 | Matsuzawa | B41J 2/14233 347/65 |
| 2012/0167823 | A1 | 7/2012 | Gardner | |
| 2013/0162725 | A1* | 6/2013 | Suzuki | B41J 2/14201 347/68 |
| 2014/0267499 | A1* | 9/2014 | Kato | B41J 2/14233 347/50 |

FOREIGN PATENT DOCUMENTS

| | | | |
|---|---|---|---|
| JP | 2012-532772 | A | 12/2012 |
| WO | 2011/068006 | A1 | 6/2011 |

* cited by examiner

LIQUID DISCHARGE HEAD AND METHOD FOR MANUFACTURING SAME

BACKGROUND OF THE INVENTION

Field of the Invention

The present disclosure relates to a liquid discharge head that discharges liquid.

Description of the Related Art

A liquid discharge head that discharges liquid is typically mounted in a liquid discharge apparatus that records an image on a record medium by discharging liquid such as ink. As a mechanism that discharges liquid from the liquid discharge head, a liquid discharge head that employs a pressure chamber that is capable being contracted by a piezoelectric transducer is known. According to the mechanism, the pressure chamber can be contracted and expanded by bending, with a deformed piezoelectric transducer to which a voltage has been applied, a diaphragm that forms a wall of the pressure chamber. With the pressure generated with the above, the liquid inside the pressure chamber is discharged through a discharge opening that is formed at one end of the pressure chamber. A liquid supply passage that supplies liquid is connected to the pressure chamber. A plurality of liquid supply passages are connected to a common liquid chamber, and liquid is supplied from the common liquid chamber.

In recent years, a liquid discharge apparatus that is capable of high-speed plotting is in need. One of such liquid discharge apparatuses achieves high-speed plotting and includes a line head in which discharge openings are arranged in a two-dimensional manner at a high density. In order to perform high-speed plotting, the discharge period of each pressure chamber needs to be short. By reducing the volume of the liquid related to the discharge, the compliance of the fluid can be reduced and the natural frequency of the pressure chamber can be increased.

PCT Japanese Translation Patent Publication No. 2012-532772 discloses a liquid discharge head in which liquid is supplied from a side that is opposite the discharge openings with respect to the diaphragms. The liquid discharge head includes an element substrate, a liquid supply substrate that is stacked on the element substrate, and a photosensitive resin layer with which the element substrate and the liquid supply substrate are adhered to each other. Liquid inflow through-holes penetrate the element substrate, the photosensitive resin layer, and the liquid supply substrate. The element substrate includes pressure chambers that include discharge openings that discharge liquid, liquid supply passages, one end of which is connected to the corresponding pressure chamber and the other end of which is connected to the corresponding liquid inflow through-hole, diaphragms that form surfaces that opposes the discharge openings of the pressure chambers, and piezoelectric transducers that applies vibration to the diaphragms. The liquid that has been supplied through the liquid inflow through-holes passes through the liquid supply passages and is supplied to the pressure chambers. Since the liquid inflow through-holes are provided on the opposite side of the discharge opening with respect to the diaphragm, the distance between the diaphragm and the discharge opening can be made short. Accordingly, the volume of the fluid can be reduced and the response frequency can be increased. The photosensitive resin layer is formed of a photosensitive photoresist SU-8 (MicroChem Corp.). Accordingly, the liquid inflow through-holes can be formed in the photosensitive resin layer by patterning.

Since the photosensitive resin layer includes the liquid inflow through-holes into which liquid flows; accordingly, by being in contact with the liquid, the photosensitive resin layer may swell. The back surface of the surface on the photosensitive resin layer side of the diaphragm is the liquid supply passage and the diaphragm is not restricted on the liquid supply passage side. Accordingly, due to swelling of the photosensitive resin layer, the diaphragm may be pushed by the photosensitive resin layer and may deform towards the liquid supply passage. The diaphragm is formed thin so that the diaphragm greatly deforms the pressure chamber, and has a thickness of 2 μm or under, for example. Due to swelling of the photosensitive resin layer, the diaphragm that has been pressed may be deformed so as to reduce the width of the liquid supply passage and, further, may be damaged.

SUMMARY OF THE INVENTION

A liquid discharge head of the present disclosure includes an element substrate, a liquid supply substrate that is stacked on the element substrate, a photosensitive resin layer that adheres the element substrate and the liquid supply substrate to each other, and a liquid inflow through-hole that penetrates the element substrate, the photosensitive resin layer, and the liquid supply substrate. The element substrate includes a pressure chamber that includes a discharge opening that discharges liquid, a liquid supply passage, one end of which is connected to the pressure chamber and another end of which is connected to the liquid inflow through-hole, the liquid supply passage supplying the liquid supplied from the liquid inflow through-hole to the pressure chamber, a diaphragm that forms a surface that opposes the discharge opening of the pressure chamber, a piezoelectric transducer that applies vibration to the diaphragm, and a partition portion, one surface of which opposes the liquid supply passage and another surface of which opposes the photosensitive resin layer through the diaphragm.

One surface of the partition portion of the element substrate opposes the liquid supply passage and another surface opposes the photosensitive resin layer through the diaphragm. In other words, the partition portion functions as a support member that supports the diaphragm from the liquid supply passage side. Even if the diaphragm is pressed towards the liquid supply passage due to swelling of the photosensitive resin layer, the pressing force is supported by the partition portion. Accordingly, large deformation of the diaphragm is prevented.

Further features of the present invention will become apparent from the following description of exemplary embodiments with reference to the attached drawings.

DESCRIPTION OF THE EMBODIMENTS

Hereinafter, exemplary embodiments of the present invention will be described with reference to the drawings.

First Exemplary Embodiment

Figure 1:
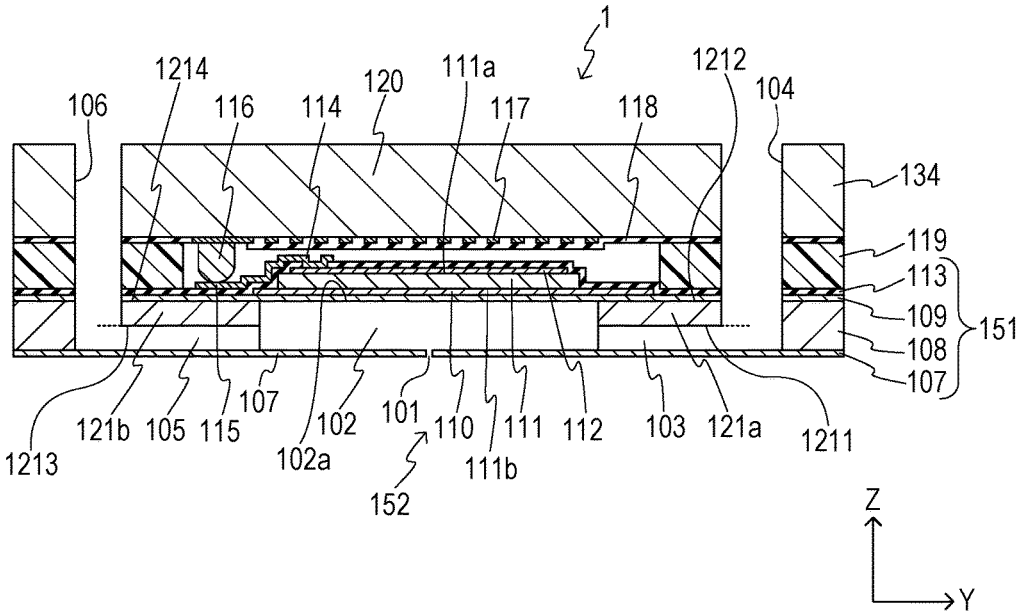
FIG. 1 is a cross-sectional view of an essential portion of a liquid discharge portion of a liquid discharge head according to an exemplary embodiment of the present disclosure.
Figure 2:
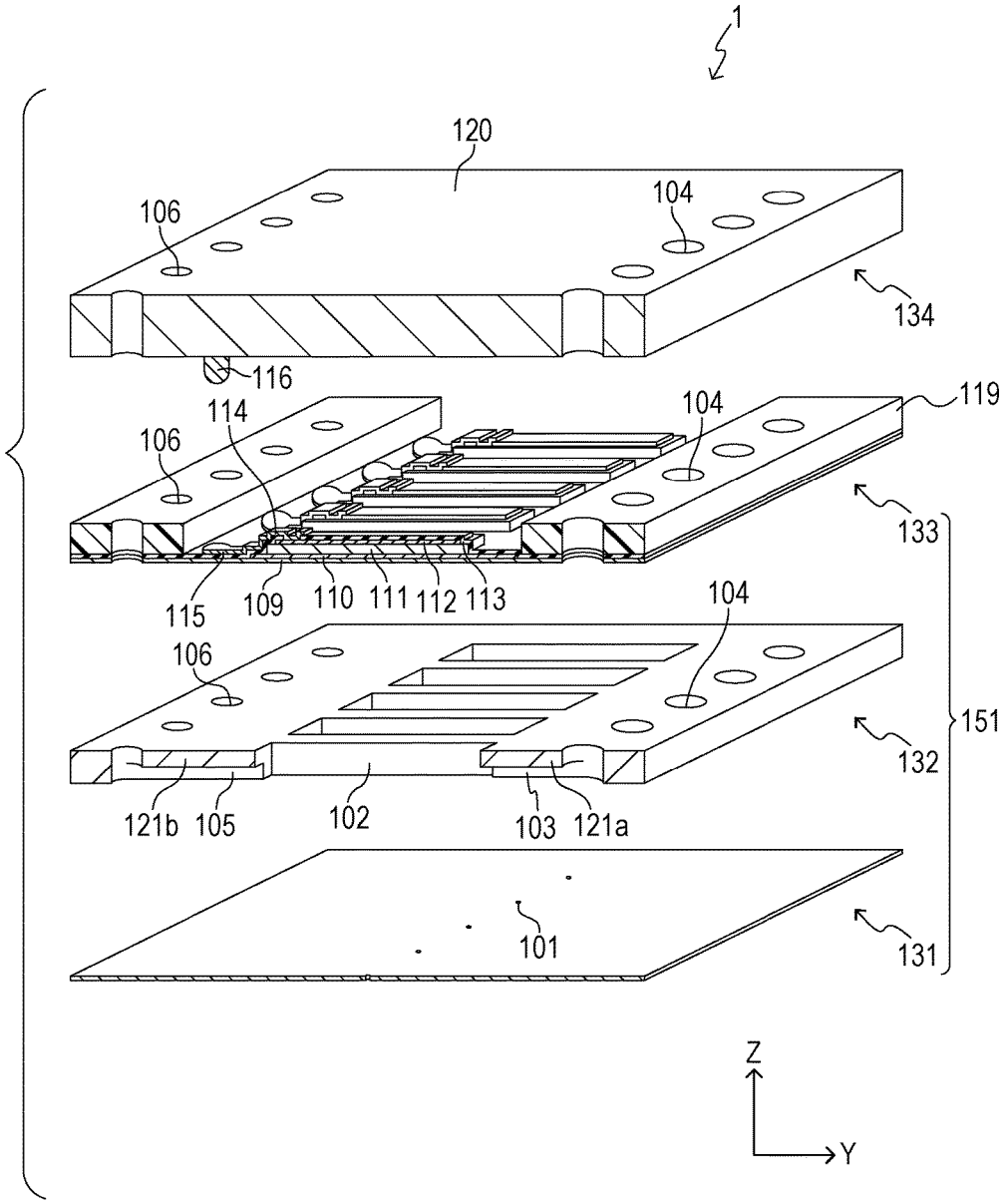
FIG. 2 is an exploded perspective view of the liquid discharge head.

FIG. 1 is a cross-sectional view of an essential portion of a liquid discharge portion 152 of a liquid discharge head 1 according to a first exemplary embodiment of the present disclosure that discharges liquid such as ink or the like. The liquid discharge head 1 is mounted in a liquid discharge apparatus, a representative example of which is an inkjet recording apparatus. FIG. 2 is an exploded perspective view of the liquid discharge head 1. The liquid discharge head 1 includes an element substrate 151, a liquid supply substrate 134, and a photosensitive resin layer 119 with which the element substrate 151 and the liquid supply substrate 134 are adhered to each other. The element substrate 151 includes a number of liquid discharge portions 152 that each includes a discharge opening 101. Each liquid discharge portion 152 includes a pressure chamber 102 that retains liquid, the discharge opening 101 that is provided so as to correspond to a pressure chamber 102 and that discharges the liquid, a diaphragm 109, and a piezoelectric transducer 111 to which the diaphragm 109 is adhered. The diaphragm 109 forms a surface 102*a* that opposes the discharge opening 101 of the pressure chamber 102. Upon application of a voltage, the piezoelectric transducer 111 deforms in an out-of-plane direction and bends the diaphragm 109. Each of the liquid discharge portions 152 further includes a liquid supply passage 103 that is in communication with the corresponding pressure chamber 102 and that supplies the liquid to the corresponding pressure chamber 102, and a liquid collection passage 105 that is in communication with the corresponding pressure chamber 102 and that collects the liquid from the corresponding pressure chamber 102. The liquid supply passage 103 and the liquid collection passage 105 have inertia that is greater than that of the discharge opening 101 so that the pressure generated inside the pressure chamber 102 is oriented towards the discharge opening 101.

A discrete electrode 112 is connected to one surface 111*a* of the piezoelectric transducer 111 and a common electrode 110 is connected to the other surface 111*b* thereof. The discrete electrode 112 is electrically drawn out with a lead-out electrode 114 and is connected to a conductive bump 116 through a bump pad 115. An Au bump, for example, may be used as the conductive bump 116. An electric wiring 117 is provided on the liquid supply substrate 134 and is connected to the bump 116. Accordingly, the discrete electrode 112 of the element substrate 151 and the electric wiring 117 of the liquid supply substrate 134 are electrically connected to each other with the bump 116. The drive voltage of the piezoelectric transducer 111 is supplied to the discrete electrode 112 from a control circuit outside of the liquid discharge head 1 through the electric wiring 117, the bump 116, and the lead-out electrode 114. The common electrode 110 extends under each of the piezoelectric transducers 111, each corresponding to a respective one of the pressure chambers 102, and is collectively connected to a control circuit outside the liquid discharge head 1 through a bump (not shown) at an end portion of the liquid discharge head 1. By using the bump 116, electrical connection between each electric wiring 117 and the corresponding piezoelectric transducer 111 is facilitated. However, the electrical connection between each electric wiring 117 and the corresponding piezoelectric transducer 111 is not limited to a connection through a bump and, for example, penetrating wiring may be used.

The liquid supply substrate 134 is stacked on the element substrate 151. The liquid supply substrate 134 has functions of supplying liquid to each of the liquid discharge portions 152 and collecting liquid from each of the liquid discharge portions 152. The liquid supply substrate 134 is adhered to the plurality of liquid discharge portions 152 that are arranged two-dimensionally and has a function of supporting the liquid discharge portions 152 while maintaining rigidity. Specifically, the liquid supply substrate 134 includes liquid inflow through-holes 104 that are in communication with the liquid supply passages 103 and liquid outflow through-holes 106 that are in communication with the liquid collection passages 105. One end of each liquid supply passage 103 is connected to the corresponding pressure chamber 102 and the other end of each liquid supply passage 103 is connected to the corresponding liquid inflow through-hole 104. Similarity, one end of each liquid collection passage 105 is connected to the corresponding pressure chamber 102 and the other end of each liquid collection passage 105 is connected to the corresponding liquid outflow through-hole 106. Liquid is supplied through the liquid inflow through-holes 104 of the liquid supply substrate 134, passes through the liquid supply passages 103 of the element substrate 151, and is supplied to the pressure chambers 102. The liquid passes through the liquid collection passages 105 of the element substrate 151 and is collected through the liquid outflow through-holes 106 of the liquid supply substrate 134. As above, the liquid discharge portions 152 form circulatory flows of the liquid. The liquid supply substrate 134 also has a function of applying electric signals to the liquid discharge portions 152. When a drive voltage from the control circuit is applied to the piezoelectric transducers 111 through the electric wiring 117 of the liquid supply substrate 134, the diaphragms 109 are deformed and the pressure chambers 102 contract and expand. With the above, the pressure of the liquid inside the pressure chamber 102 increases/decreases and upon increase/decrease of the pressure, the liquid is discharged from the discharge openings 101.

Referring to FIG. 2, the element substrate 151 includes a pressure chamber forming layer 132, a discharge opening forming member 131, and a drive layer 133 that is provided with the diaphragms 109. The pressure chamber forming layer 132 and the discharge opening forming member 131 according to the present exemplary embodiment are both formed of silicon (Si). Together with the diaphragms 109, the pressure chamber forming layer 132 and the discharge opening forming member 131 form the pressure chambers 102. The discharge openings 101 that discharge liquid are formed in the discharge opening forming member 131.

Water repellent finishing is performed on a surface of the discharge opening forming member 131 opposite to the pressure chamber 102. Portions of each of the pressure chambers 102, the liquid supply passages 103, the liquid collection passages 105, the liquid inflow through-holes 104, and the liquid outflow through-holes 106 are formed in the pressure chamber forming layer 132. The diaphragms 109, the common electrode 110, the piezoelectric transducers 111, the discrete electrodes 112, protective films 113 that perform insulation protection on the above, and lead-out electrodes 114 are formed in the drive layer 133. As will be described later, the pressure chamber forming layer 132 and the drive layer 133 are formed integrally. Openings that configure portions of the liquid inflow through-holes 104 and openings that configure portions of the liquid outflow through-holes 106 are formed in the liquid supply substrate 134. The electric wiring 117 that applies a drive voltage to the piezoelectric transducer 111 through the bump 116, and a protective film 118 for performing insulation protection on the electric wiring 117 are further formed on the liquid supply substrate 134.

The photosensitive resin layer 119 is disposed between the element substrate 151 and the liquid supply substrate 134. The photosensitive resin layer 119 adheres the drive layer 133 and the liquid supply substrate 134 to each other and also has a function of a spacer that secures spaces in which the common electrode 110, the piezoelectric transducers 111, and the discrete electrodes 112 are disposed. A photosensitive dry film such as, for example, DF470 (Hitachi Chemical Co., Ltd.) may be used for the photosensitive resin layer 119. It is only sufficient that the photosensitive resin layer 119 is formed of a resin material on which photopatterning can be performed and may be formed of a photosensitive liquid resist or may be formed of a photosensitive film. By using the photosensitive resin layer 119, the drive layer 133 and the liquid supply substrate 134 can be adhered to each other and the photosensitive resin layer 119 can be cured at the same time when heating and pressing are performed to connect the bumps 116.

The liquid inflow through-holes 104 and the liquid outflow through-holes 106 extend so as it penetrate through the pressure chamber forming layer 132, the drive layer 133, the photosensitive resin layer 119, and the liquid supply substrate 134. Accordingly, openings that configure the liquid inflow through-holes 104 and the liquid outflow through-holes 106 are formed by patterning in the diaphragms 109, the protective films 113, and the photosensitive resin layer 119.

The element substrate 151 includes a partition portion 121*a*, one surface 1211 of the element substrate 151 in a thickness direction Z opposes the liquid supply passages 103 and another surface 1212 of the element substrate 151 in the thickness direction Z opposes the photosensitive resin layer 119 through the diaphragms 109. Similarly, the element substrate 151 includes a second partition portion 121*b*, one surface 1213 of the element substrate 151 in the thickness direction Z opposes the liquid collection passage 105 and another surface 1214 of the element substrate 151 in the thickness direction Z opposes the photosensitive resin layer 119 through the diaphragms 109. The partition portions 121*a* and 121*b* each have a rectangular cross-sectional shape when cut along a plane (a Y-Z plane) including the thickness direction Z of the element substrate 151 and direction Y in which the liquid supply passages 103 or the liquid collection passages 105 extends. In other words, sidewalls of the liquid supply passages 103, the liquid collection passages 105, and the pressure chambers 102 vertically stand from the Y-Z plane of the element substrate 151 and extend in the thickness direction Z of the element substrate 151 so as to be parallel to the thickness direction Z of the element substrate 151. The partition portions 121*a* and 121*b* formed of silicon are disposed on the diaphragm 109 side of the liquid supply passages 103 and the liquid collection passages 105 and have functions of throttling the flow paths of the liquid supply passages 103 and the liquid collection passages 105 and suppressing deformation of the diaphragms 109. Since the photosensitive resin layer 119 contains resin, the photosensitive resin layer 119 being in contact with liquid becomes swollen and applies pressing force to the diaphragms 109 towards the liquid supply passages 103 and the liquid collection passages 105 (downwards in FIG. 1). The partition portions 121*a* and 121*b* are portions of the pressure chamber forming layer 132 and are formed of Si. Accordingly, the rigidity thereof is high compared with the rigidity of the diaphragm 109 such that the partition portions 121*a* and 121*b* effectively suppress deformations of the diaphragms 109. With the above, change in the sectional areas of the liquid supply passages 103 and the liquid collection passages 105 and damage in the diaphragms 109 due to deformation of the diaphragms 109 can be prevented.

Figure 3:
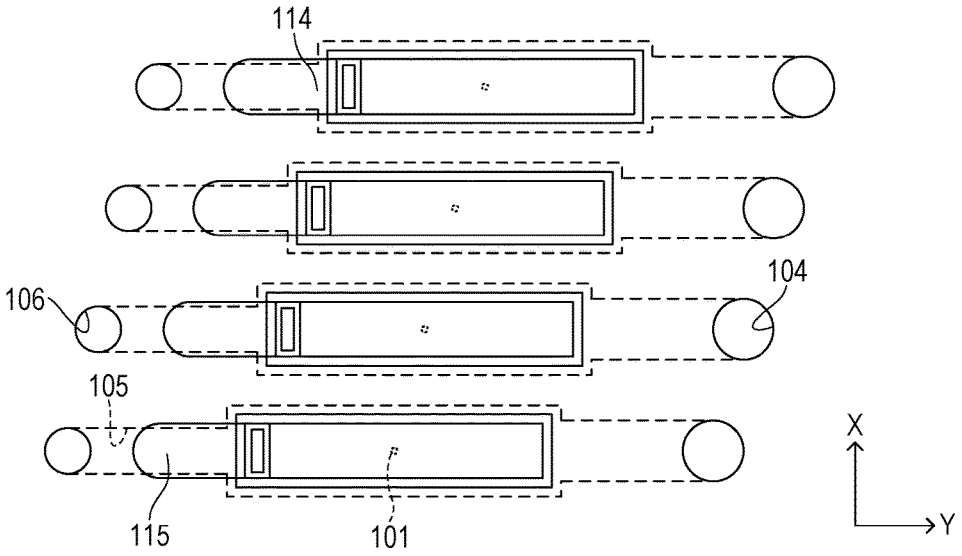
FIG. 3 is a top view illustrating liquid supply passages and lead-out electrodes of the liquid discharge head.
Figure 4:
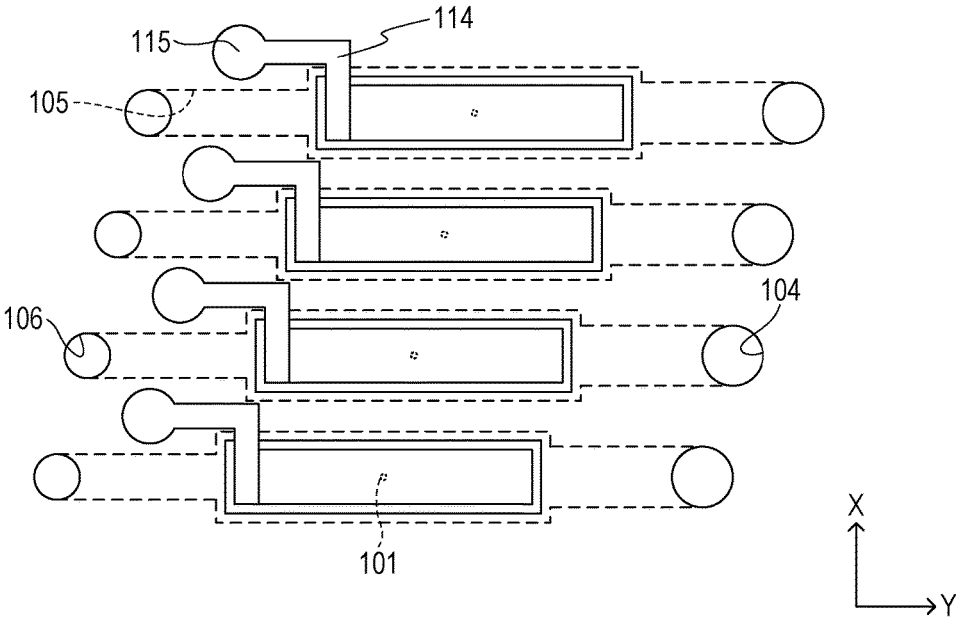
FIG. 4 is a top view illustrating another example of the lead-out electrode of the liquid discharge head.

FIG. 3 illustrates a top view of the liquid discharge head 1 of the present exemplary embodiment. The discharge openings 101 are disposed so as to be offset with respect each other by, for example, 1200 dpi (21.17 μm) in direction Y. By discharging the liquid while, at the same time, an object to be drawn is relatively moved with respect to the liquid discharge head 1 in direction X, an image of 1200 dpi is formed. The lead-out electrodes 114 are drawn out in direction Y, in other words, is drawn out along the liquid collection passages 105, and the bump pads 115 are formed on the end portions of the lead-out electrodes 114. The shape of each lead-out electrode 114 is not limited to the above shape and as illustrated in FIG. 4, each lead-out electrode 114 may be formed at a position avoiding the corresponding liquid collection passage 105, and each bump pad 115 may be provided at a position that does not overlap the corresponding liquid collection passage 105. In other words, each bump 116 may be positioned so as not to overlap the corresponding liquid collection passage 105 when viewed in the thickness direction Z of the element substrate 151. With the above, a load or a pressing force applied to the liquid collection passages 105 from the bumps 116 caused by heat expansion and the like can be prevented. Note that the lead-out electrodes 114 and the bump pads 115 may be provided not on the liquid collection passages 105 side but on the liquid supply passages 103 side. In such a case as well, each bump 116 may be positioned so as not to overlap the corresponding liquid supply passage 103 when viewed in the thickness direction Z of the element substrate 151.

Figure 5:
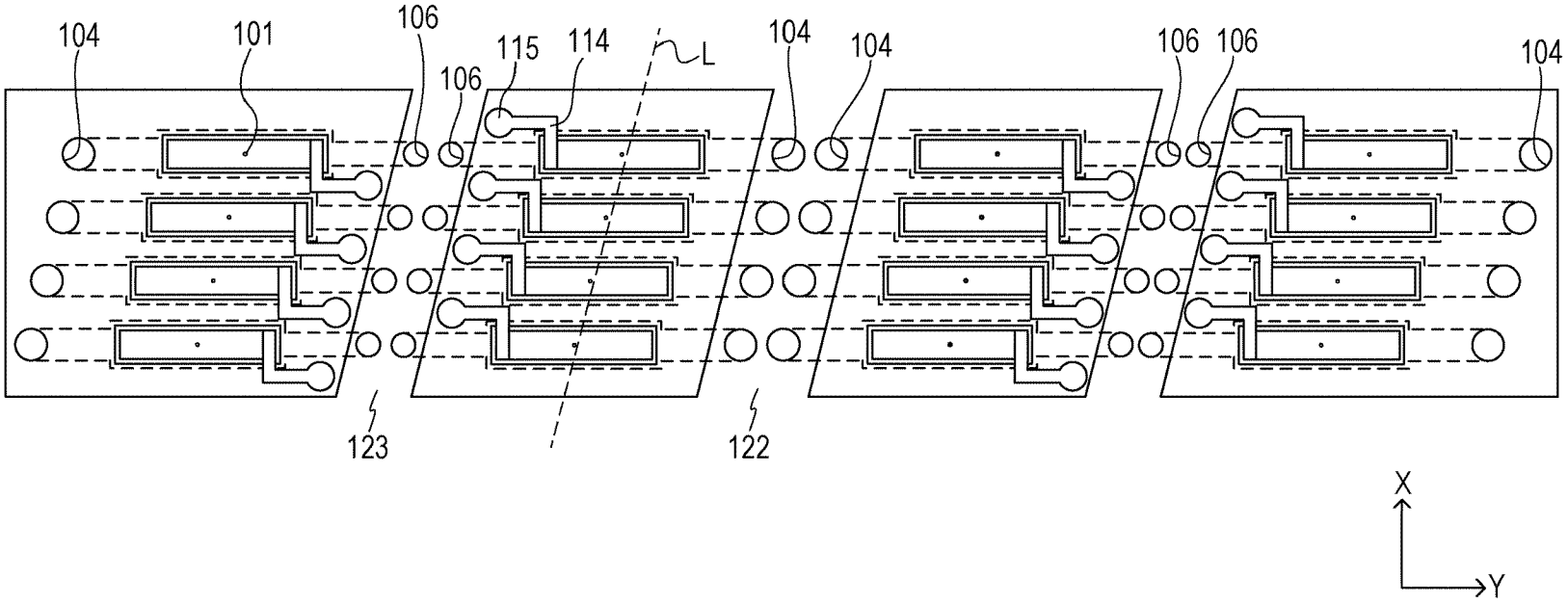
FIG. 5 is a two-dimensional arrangement drawing of discharge openings.

FIG. 5 illustrates a state in which the discharge openings 101 are arranged two-dimensionally. The liquid inflow through-hole 104 and the liquid outflow through-hole 106 are disposed alternatively and common liquid inflow passages 122 and common liquid outflow passages 123 are formed so as to extend along discharge opening arrays L. With the above, a larger number of discharge openings 101 can be efficiently disposed in the liquid discharge head 1. The lead-out electrodes 114 are drawn out in the same direction within a single discharge opening array L and are drawn out in the opposite direction with respect to the lead-out electrodes 114 of the adjacent discharge opening array L. Furthermore, the adjacent lead-out electrodes 114 of the adjacent discharge opening arrays L are in a point symmetrical relationship with each other and the positional relationship between each discharge opening 101 and the corresponding lead-out electrode 114 can be the same.

A method for fabricating the liquid discharge head 1 of the present exemplary embodiment will be described using FIGS. 6A to 8I.

Figure 6A:
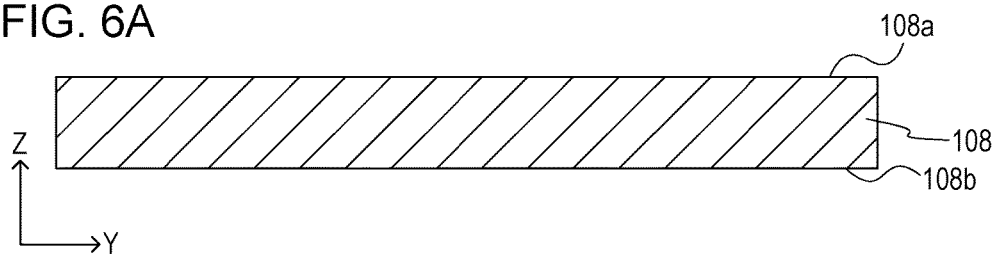
FIGS. 6A to 6K are diagrams illustrating a flow of a fabrication process of an element substrate.
Figure 6B:
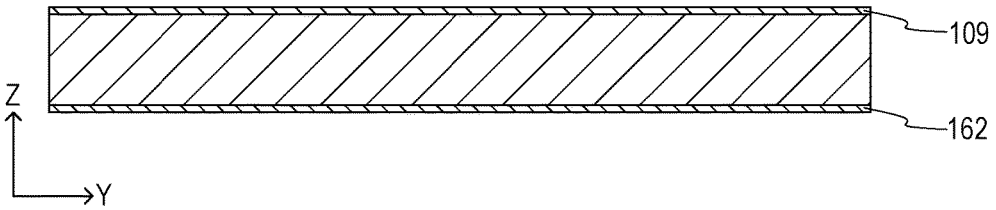
Figure 6C:
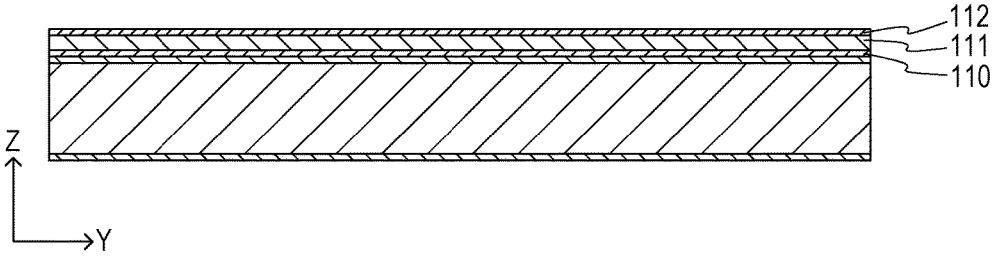
Figure 6D:
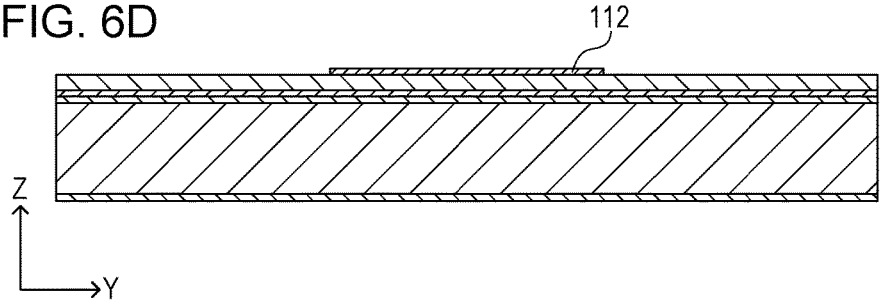
Figure 6E:
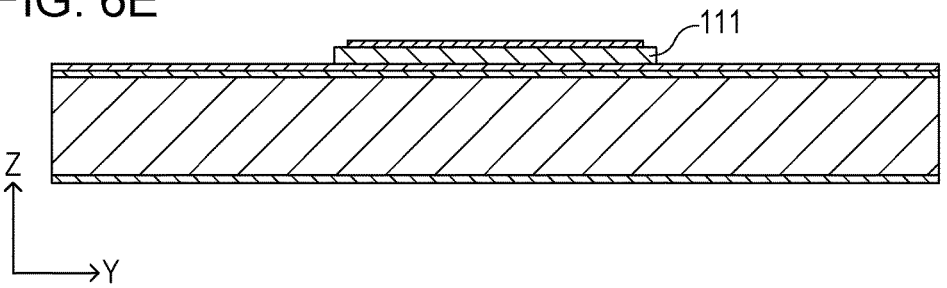
Figure 6F:
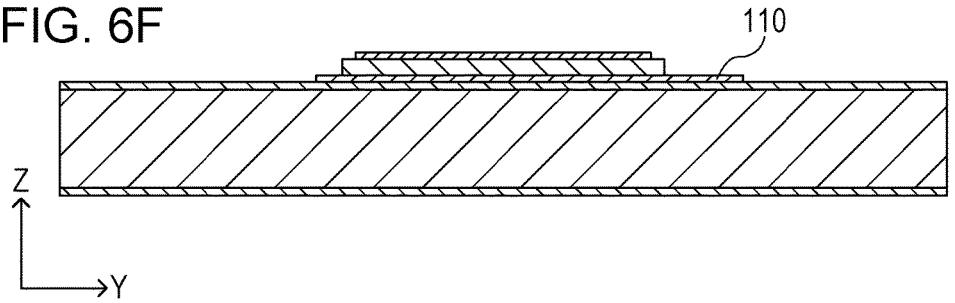
Figure 6G:
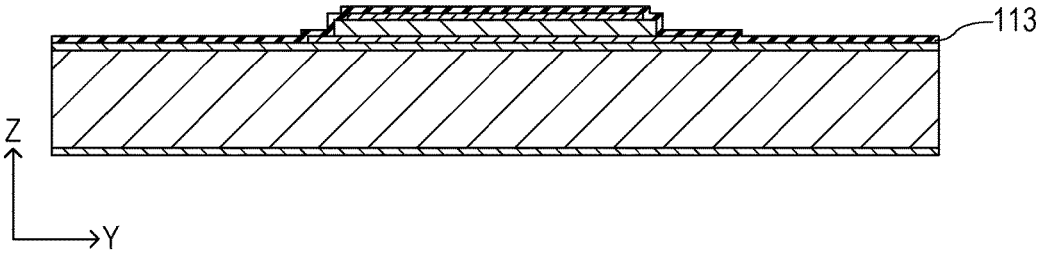
Figure 6H:
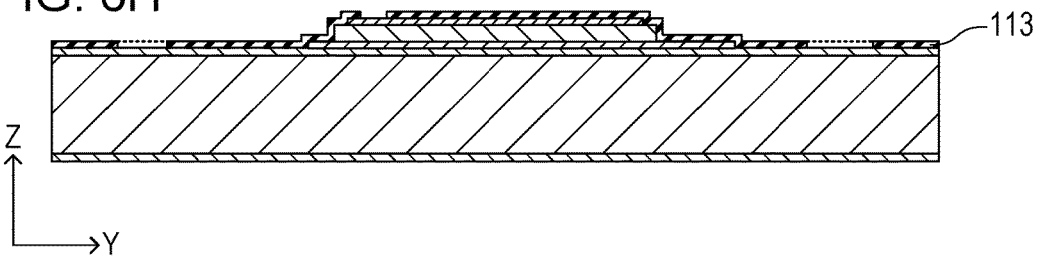
Figure 6I:
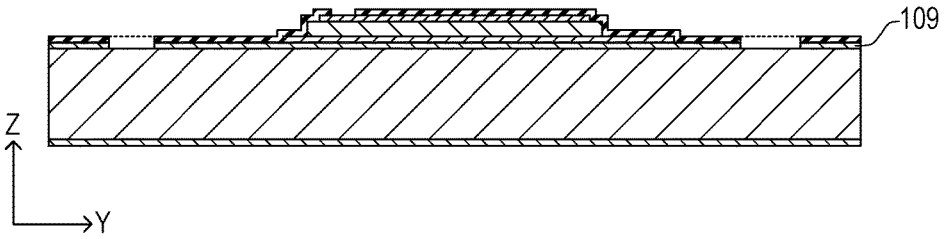
Figure 6J:
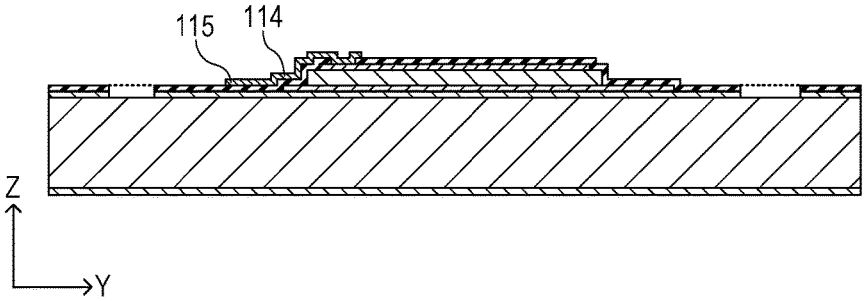
Figure 6K:
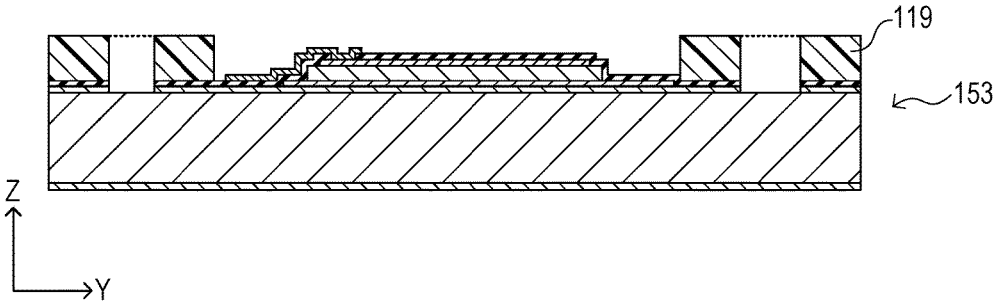

FIGS. 6A to 6D are diagrams illustrating a flow of a fabrication process of the pressure chamber forming layer 132 and the drive layer 133. An Si substrate 108 is prepared (FIG. 6A), and a nitride film that is to be the diaphragms 109 is deposited on a first surface 108*a* of the Si substrate 108 and an oxidized layer 162 is deposited on a second surface 108*b* (FIG. 6B). Subsequently, a common electrode 110, a piezoelectric transducer 111, and a discrete electrode 112 are deposited (FIG. 6C). Subsequently, by etching processes, the discrete electrodes 112 are patterned (FIG. 6D), the piezoelectric transducers 111 are patterned (FIG. 6E), and the common electrode 110 is patterned (FIG. 6F). Then, a protective film 113 is formed (FIG. 6G). Subsequently, the protective films 113 are patterned (FIG. 6H), the diaphragms 109 that are each formed of a nitride film are patterned (FIG. 6I), and portions of the liquid inflow through-holes 104 and the liquid outflow through-holes 106 are formed. Subsequently, the lead-out electrodes 114 and the bump pads 115 are formed (FIG. 6J). Subsequently, the photosensitive resin layer 119 is patterned and portions of the liquid inflow through-holes 104 and the liquid outflow through-holes 106 are formed (FIG. 6K). As described above, the pressure chamber forming layer 132 and the drive layer 133 are formed. Note that the pressure chamber forming layer 132 and the drive layer 133 are collectively referred to as an actuator substrate 153.

Figure 7A:
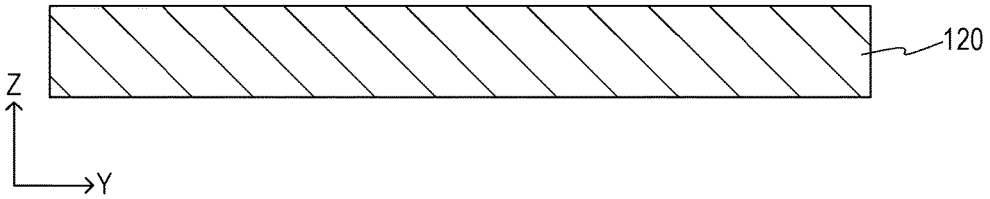
FIGS. 7A to 7J are diagrams illustrating a flow of a fabrication process of a liquid supply substrate.
Figure 7B:
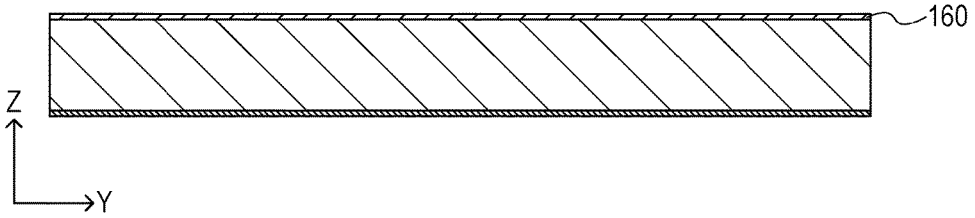
Figure 7C:
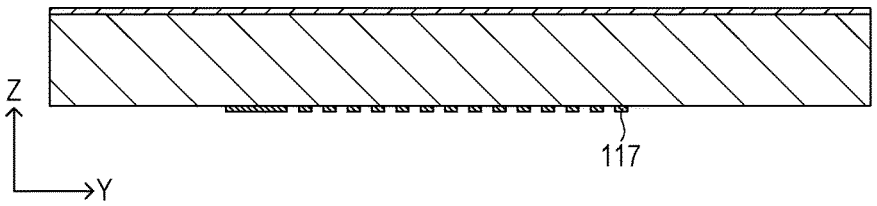
Figure 7D:
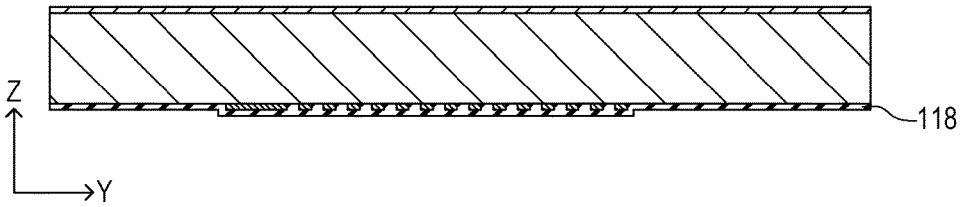
Figure 7E:
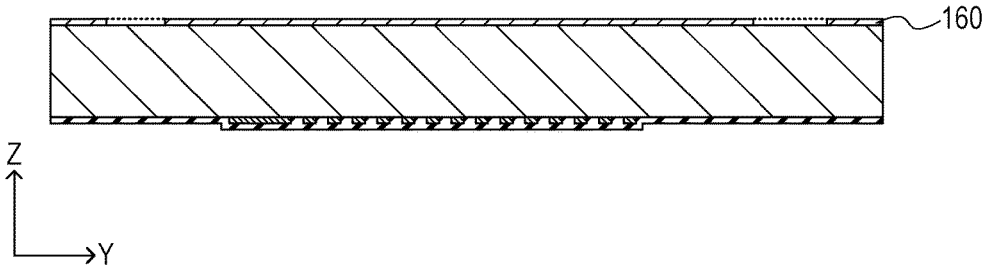
Figure 7F:
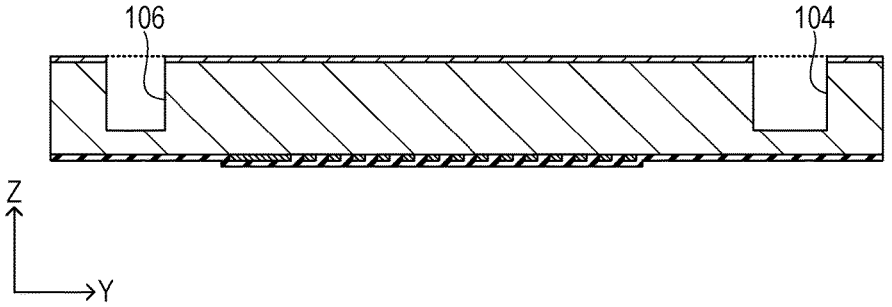
Figure 7G:
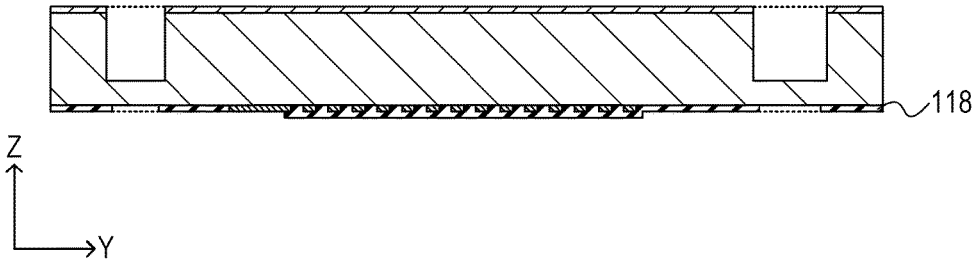
Figure 7H:
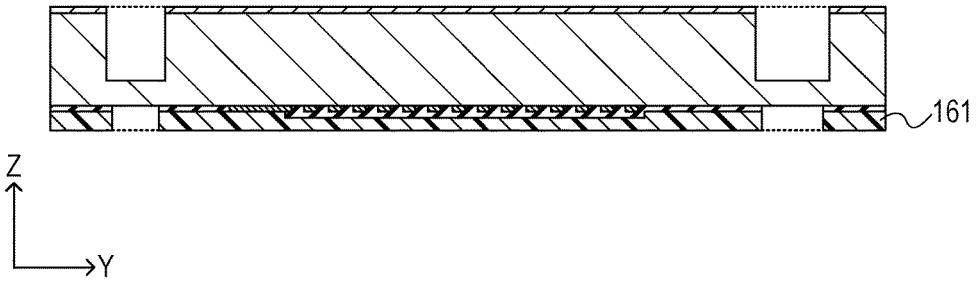
Figure 7I:
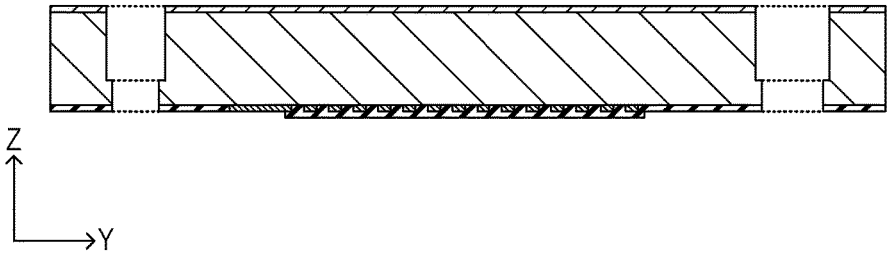
Figure 7J:
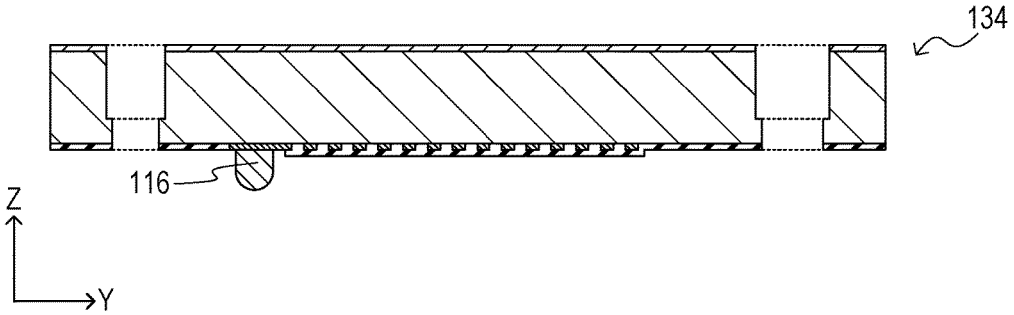

FIGS. 7A to 7J are diagrams illustrating a flow of a fabrication process of the liquid supply substrate 134. First, a substrate 120 formed of Si is prepared (FIG. 7A). Subsequently, an oxide film 160 is deposited on the Si substrate 120 (FIG. 7B), the electric wiring 117 is patterned (FIG. 7C), and a protective film 118 is formed (FIG. 7D). Subsequently, the oxide film 160 is patterned (FIG. 7E), and the liquid inflow through-holes 104 and the liquid outflow through-holes 106 are formed by deep etching to a portion midway of the substrate 120 from the side of the substrate 120 opposite the drive layer 133 (FIG. 7F). Subsequently, the protective film 118 is patterned (FIG. 7G) and the protective film 118 is covered by a resist mask 161 (FIG. 7H). Subsequently, the liquid inflow through-holes 104 and the liquid outflow through-holes 106 are formed by deep etching from the drive layer 133 side such that the liquid inflow through-holes 104 and the liquid outflow through-holes 106 penetrate through, and the resist mask 161 is removed (FIG. 7I). Last of all, the bumps 116 are disposed (FIG. 7J).

Figure 8A:
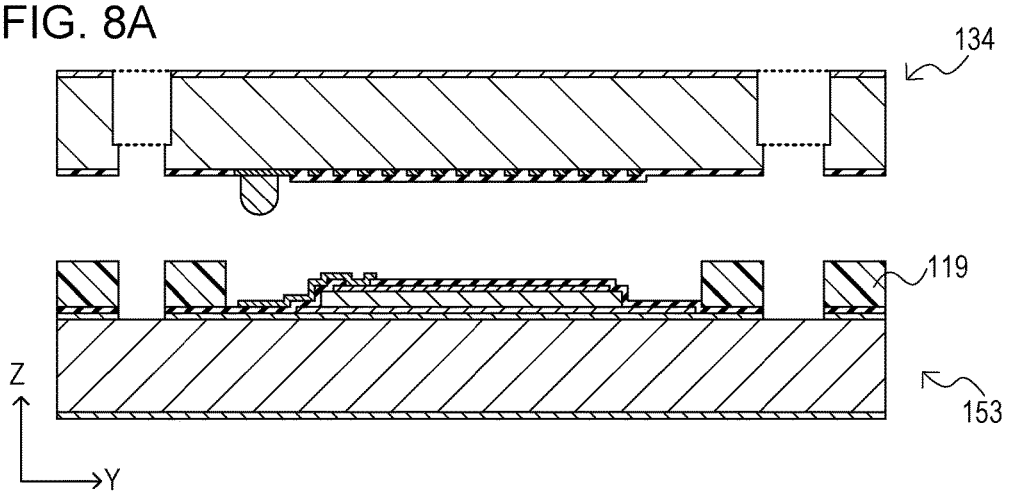
FIGS. 8A to 8I are diagrams illustrating a flow of a procedure adhering the element substrate and the liquid supply substrate to each other and forming a pressure chamber.
Figure 8B:
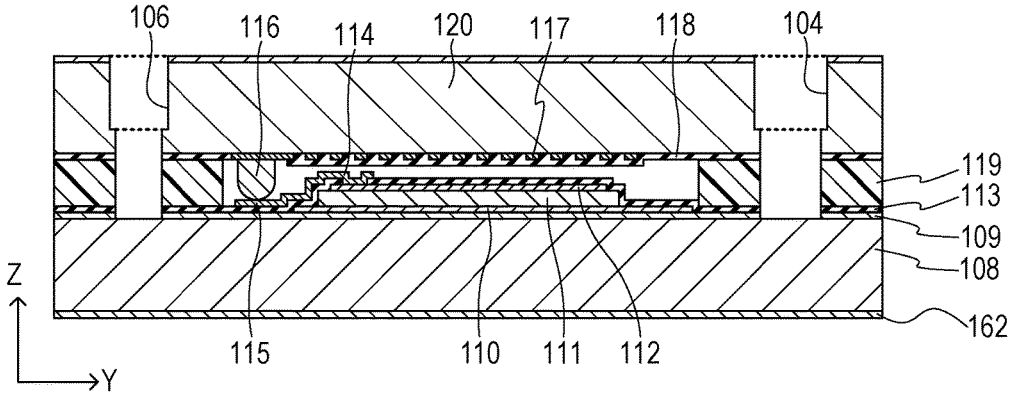
Figure 8C:
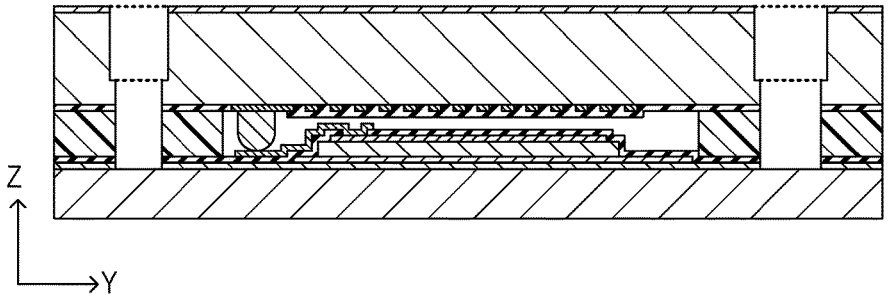
Figure 8D:
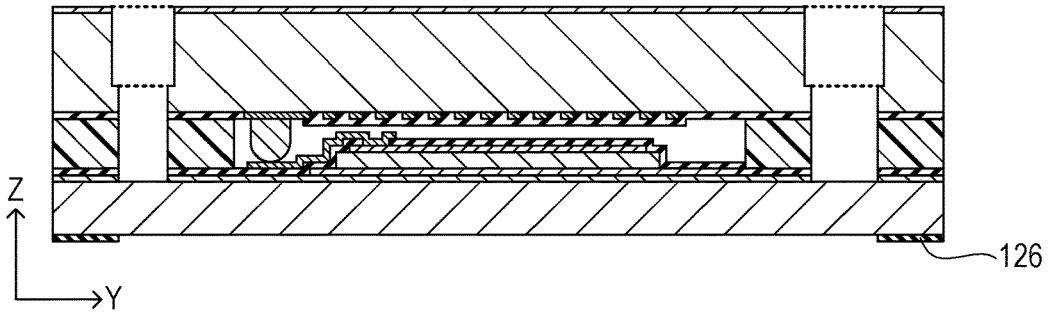
Figure 8E:
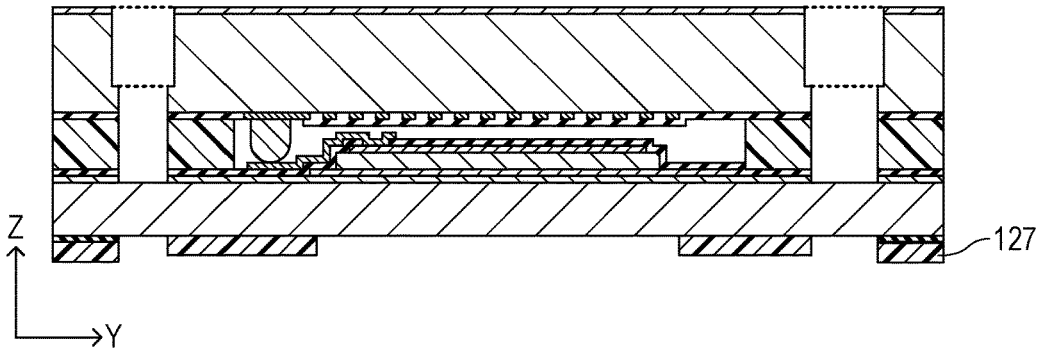
Figure 8F:
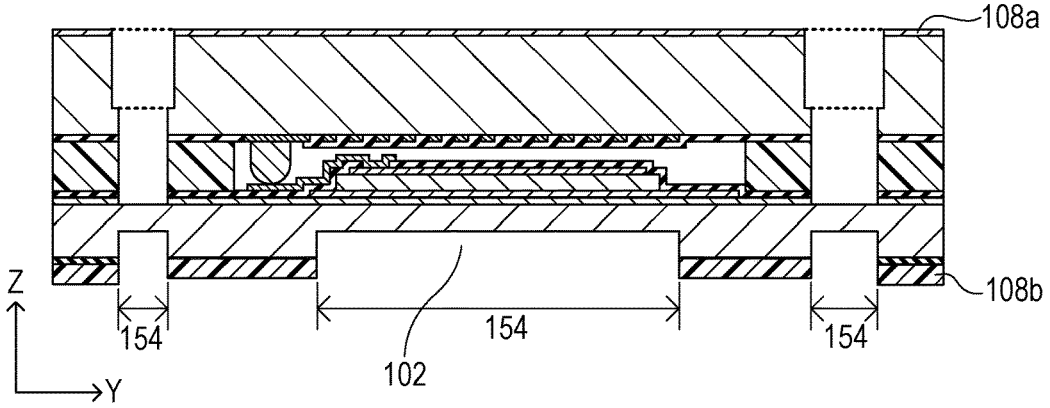
Figure 8G:
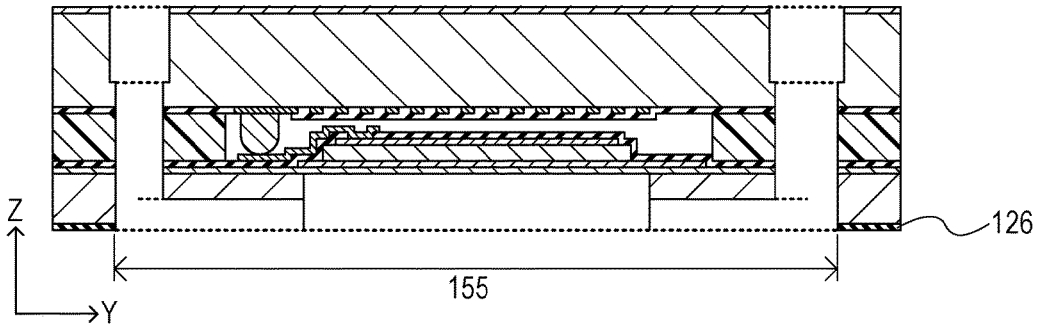
Figure 8H:
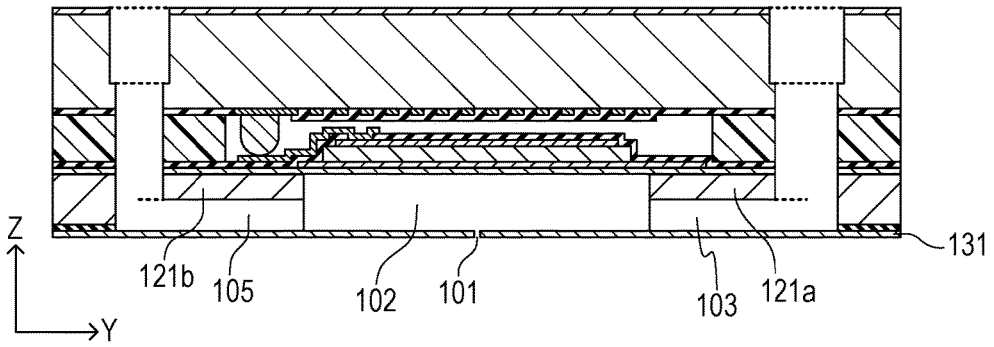

FIGS. 8A to 8I are diagrams illustrating a flow of an adhesion process between the liquid supply substrate 134 and the element substrate 151 and a flow of a formation process of the pressure chambers 102. First, the liquid supply substrate 134 and the actuator substrate 153 that have been fabricated by the fabrication process described above are prepared (FIG. 8A), the liquid supply substrate 134 and the actuator substrate 153 are adhered to each other with the photosensitive resin layer 119 and are connected to the bumps 116 (FIG. 8B). Subsequently, the oxidized layer 162 of the actuator substrate 153 is removed (FIG. 8C) and the $SiO_2$ mask 126 and the resist mask 127 are sequentially formed (FIGS. 8D and 8E). After that, etching is performed from the second surface 108*b* that is the back surface of the first surface 108*a* and portions of the pressure chambers 102 are formed (a first etching process) (FIG. 8F). The areas in which etching are performed are first areas 154 where the pressure chambers 102, the liquid inflow through-holes 104, and the liquid outflow through-holes 106 are formed. After that, the resist mask 127 is removed, etching is further performed on the second surface 108*b*, and the remaining portion of the pressure chambers 102, the liquid supply passages 103, and the liquid collection passages 105 are formed (a second etching process) (FIG. 8G). At the same time, the liquid inflow through-holes 104 and the liquid outflow through-holes 106 penetrate the element substrate 151, the photosensitive resin layer 119, and the liquid supply substrate 134. The areas in which the element substrate 151 is etched are second areas 155 from the liquid inflow through-holes 104 to the liquid outflow through-holes 106. Finally, the discharge opening forming member 131 in which the discharge openings 101 are formed is adhered to the second surface 108*b* of the Si substrate 108 (FIG. 8H) and the fabrication of the liquid discharge head 1 of the present exemplary embodiment is completed.

Figure 8I:
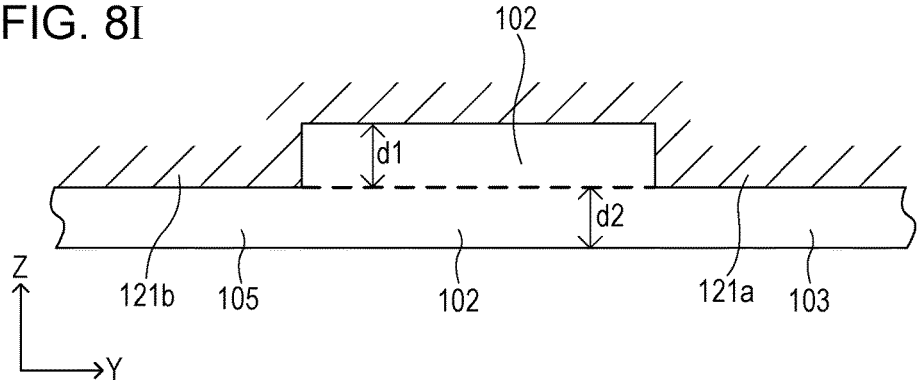

As illustrated in FIG. 8I, a depth d1 of the deep etching of the first etching process is equivalent to the thickness of the partition portions 121*a* and 121*b*, and a depth d2 of the deep etching of the second etching process is equivalent to the depth of the liquid supply passages 103 and the liquid collection passages 105. Accordingly, by adjusting the depths d1 and d2 of the deep etching, the thicknesses of the partition portions 121*a* and 121*b* and the depths of the liquid supply passages 103 and the liquid collection passages 105 can be adjusted. By forming the diaphragms 109 with nitride films, the partition portions 121*a* and 121*b* and the diaphragms 109 becomes integrated; accordingly, the rigidity is further increased and deformation of the diaphragms 109 can be suppressed.

In the present exemplary embodiment, deep etching (Deep-RIE) is used to form the pressure chambers 102, the liquid supply passages 103, the liquid collection passages 105, the liquid inflow through-holes 104, and the liquid outflow through-holes 106, and flow paths in which the side surfaces are substantially perpendicular (extending along direction Z) are formed. Unlike anisotropic etching, since oblique surfaces are not exposed, the discharge openings can be disposed efficiently with high-density.

Figure 9:
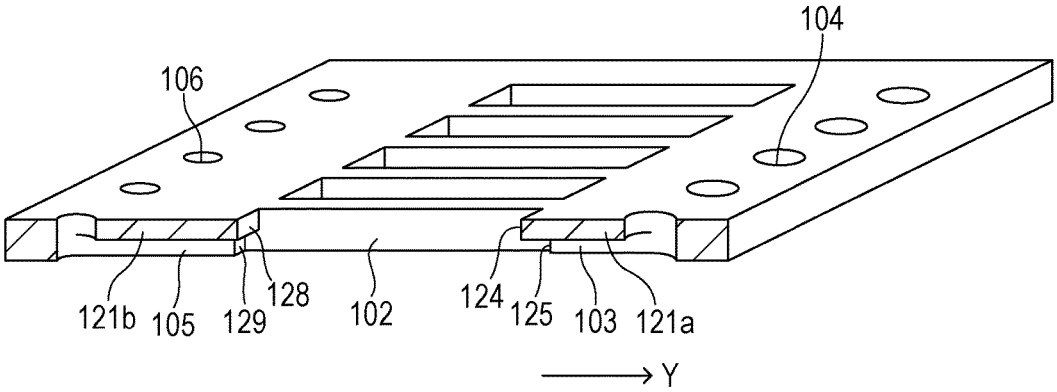
FIG. 9 is a cross-sectional view illustrating another exemplary embodiment of the pressure chamber.

The area that is etched in the first etching process is defined by the resist mask 127, and the area that is etched in the second etching process is defined by the $SiO_2$ mask 126. Accordingly, the sizes of the pressure chambers 102 can be changed by adjusting the positions and sizes of the masks. As described above, portions of the pressure chambers 102 are formed in the first etching process and the remaining portions of the pressure chambers 102 is formed in the second etching process. As illustrated in FIG. 9, the lengths of the pressure chambers 102 from walls 124 on the liquid supply passage 103 side to walls 128 on the liquid collection passage 105 side are defined by the first etching process that uses the resist mask 127. The lengths of the pressure chambers 102 from walls 125 on the liquid supply passage 103 side to walls 129 on the liquid collection passage 105 side are defined by the second etching process that uses the $SiO_2$ mask 126. In such a case, by setting the resist mask 127 smaller than the $SiO_2$ mask 126, a step is formed in the pressure chamber 102. With the above, the length of the partition portions 121*a* and 121*b* on the diaphragms 109 side in the liquid supply direction and collection direction Y can be made longer than the length of the liquid supply passages 103 and the liquid collection passages 105 in the liquid supply direction and collection direction Y. In other words, the lengths of the remaining portions of the pressure chambers 102 described above in the supply direction Y can be made shorter than the lengths of the portions of the pressure chambers 102 described above in the liquid supply direction Y. Accordingly, the rigidity of the partition portions 121*a* and 121*b* can be increased further and the effect caused by swelling of the photosensitive resin layer 119 described above can be further reduced.

Second Exemplary Embodiment

Figure 10:
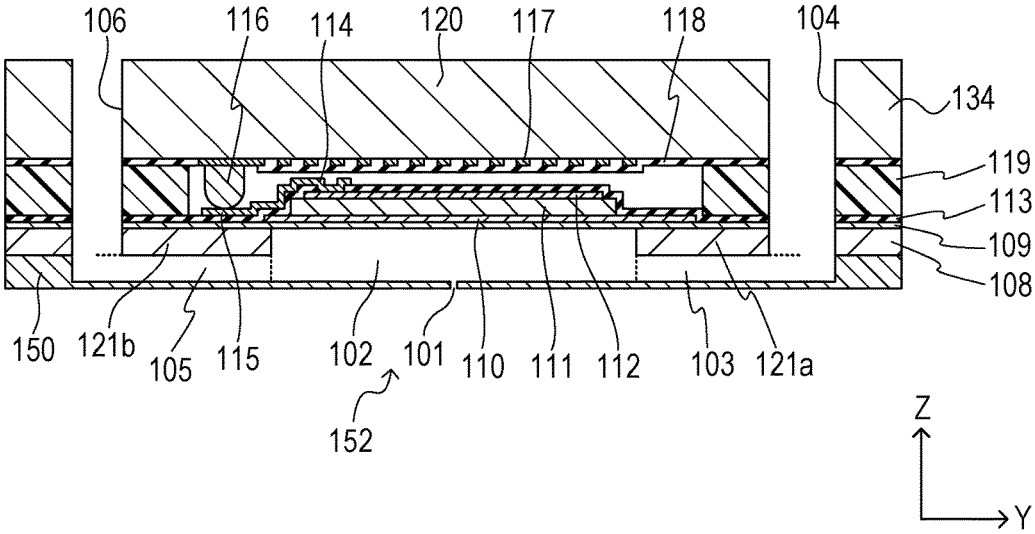
FIG. 10 is a cross-sectional view of an essential portion of a liquid discharge head of a second exemplary embodiment.
Figure 11:
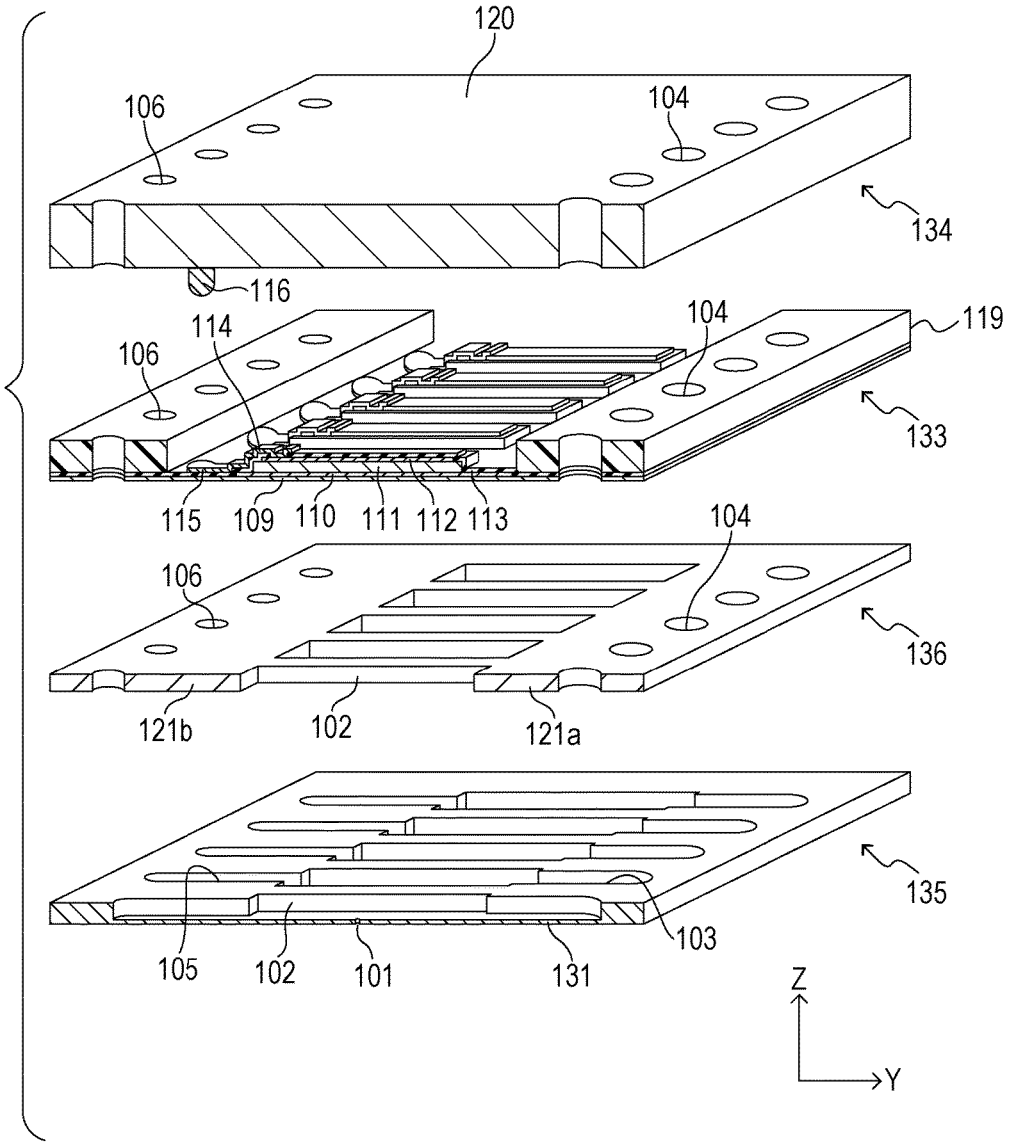
FIG. 11 is an exploded perspective view of the liquid discharge head of the second exemplary embodiment.

FIG. 10 is a cross-sectional view of a liquid discharge portion 152 of a liquid discharge head according to a second exemplary embodiment of the present disclosure, and FIG. 11 is an exploded perspective view of the liquid discharge head. In the present exemplary embodiment, the pressure chamber forming layer is divided in the thickness direction Z of the element substrate 151 into a first pressure chamber forming layer 135 and a second pressure chamber forming layer 136 at a boundary between the liquid supply passage 103 and the partition portion 121*a* and at a boundary between the liquid collection passage 105 and the partition portion 121*b*. Portions of the pressure chambers 102 in the height direction, the liquid supply passages 103, the liquid collection passages 105, and the discharge openings 101 are formed in the first pressure chamber forming layer 135. In other words, the pressure chamber forming layer 135 is integrally formed with the discharge opening forming member 131. The remaining portions of the pressure chamber 102 in the height direction, the liquid inflow through-holes 104, the liquid outflow through-holes 106, and the partition portions 121*a* and 121*b* are formed in the second pressure chamber forming layer 136. The first pressure chamber forming layer 135 and the second pressure chamber forming layer 136 are both formed of a Si substrate. Since there is no need to form the pressure chamber 102 by etching processes of two stages, as is the case of the pressure chamber forming layer 132 of the first exemplary embodiment, the dimensional accuracy of the pressure chamber 102 can be increased and the number of processes can be reduced. In the first pressure chamber forming layer 135, the pressure chambers 102 and the like and the discharge openings 101 can be formed by both-sided etching, and by using a substrate with an etching stop layer (an SOI substrate, for example), the accuracy in thickness can be increased. Note that the drive layer 133, the photosensitive resin layer 119, and the liquid supply substrate 134 are similar to those of the first exemplary embodiment.

Third Exemplary Embodiment

Figure 12:
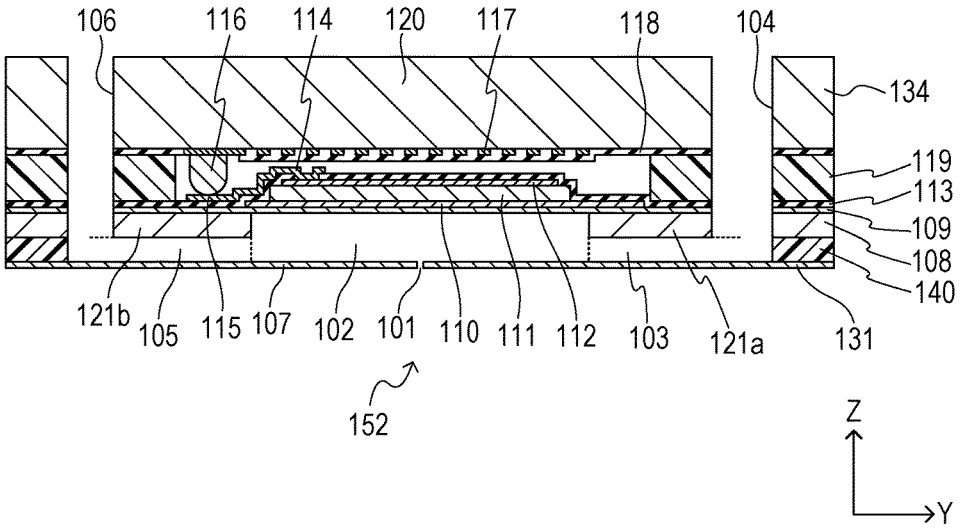
FIG. 12 is a cross-sectional view of an essential portion of a liquid discharge head of a third exemplary embodiment.
Figure 13:
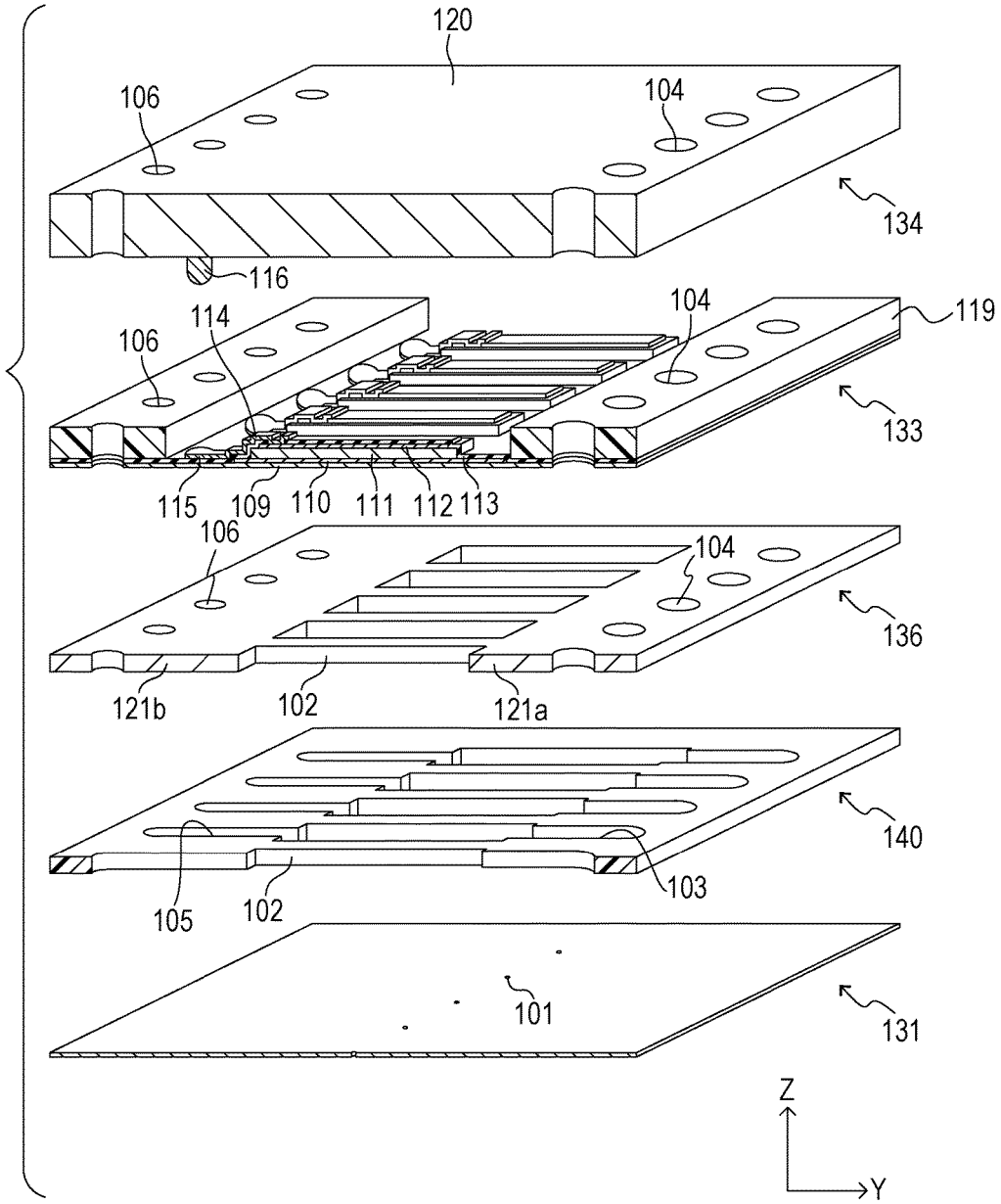
FIG. 13 is an exploded perspective view of the liquid discharge head of the third exemplary embodiment.

FIG. 12 is a cross-sectional view of a liquid discharge portion 152 of a liquid discharge head according to a third exemplary embodiment of the present disclosure, and FIG. 13 is an exploded perspective view of the liquid discharge head. In the present exemplary embodiment, the first pressure chamber forming layer 135 of the second exemplary embodiment is divided into the discharge opening forming member 131 and a pressure chamber sidewall forming layer 140 in which sidewalls of the pressure chambers 102 are formed. The pressure chamber sidewall forming layer 140 is formed of photosensitive resin and adheres the discharge opening forming member 131 and the second pressure chamber forming layer 136 to each other. Portions of the pressure chambers 102, the liquid supply passages 103, and the liquid collection passages 105 are formed in the pressure chamber sidewall forming layer 140. Similar to the second exemplary embodiment, the remaining portions of the pressure chambers 102 in the height direction, the liquid inflow through-holes 104, the liquid outflow through-holes 106, and the partition portions 121*a* and 121*b* are formed in the second pressure chamber forming layer 136. By forming the pressure chamber sidewall forming layer 140 with photosensitive resin, accurate patterning through exposure can be performed and, further, the discharge opening forming member 131 and the second pressure chamber forming layer 136 can be adhered to each other. While accurately forming the discharge opening forming member 131 and the second pressure chamber forming layer 136, by forming the pressure chamber sidewall forming layer 140 with photosensitive resin, cost can be reduced. Note that the discharge opening forming member 131, the drive layer 133, the photosensitive resin layer 119, and the liquid supply substrate 134 are similar to those of the first exemplary embodiment.

As described above, the present disclosure is capable of providing a liquid discharge head that can suppress deformation of the diaphragms caused by swelling of the photosensitive resin coming in contact with liquid.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-175515, filed Aug. 29, 2014, which is hereby incorporated by reference herein in its entirety.

What is claimed is:

1. A liquid discharge head, comprising:

an element substrate;

a liquid supply substrate that is stacked on the element substrate;

a photosensitive resin layer disposed between the element substrate and the liquid supply substrate; and a liquid inflow through-hole that penetrates the element substrate, the photosensitive resin layer, and the liquid supply substrate, wherein the element substrate includes, a pressure chamber that includes a discharge opening that discharges liquid, a liquid supply passage, one end of which is connected to the pressure chamber and another end of which is connected to the liquid inflow through-hole, the liquid supply passage supplying the liquid supplied from the liquid inflow through-hole to the pressure chamber, a diaphragm that forms a surface that opposes the discharge opening of the pressure chamber, a piezoelectric transducer that applies vibration to the diaphragm and is provided inside the photosensitive resin layer, and a partition portion, one surface of which opposes the liquid supply passage and another surface of which opposes the photosensitive resin layer through the diaphragm, and a liquid outflow through-hole that penetrates the element substrate, the photosensitive resin layer, and the liquid supply substrate, wherein the element substrate includes a liquid collection passage, one end of which is connected to the pressure chamber and another end of which is connected to the liquid outflow through-hole, the liquid collection passage making the liquid that has flowed in from the pressure chamber to flow out to the liquid outflow through-hole, and a second partition portion, one surface of which opposes the liquid collection passage and another surface of which opposes the photosensitive resin layer through the diaphragm, wherein the liquid inflow through-hole, the liquid supply passage, the pressure chamber, the liquid collection passage and the liquid outflow through-hole are provided consecutively in this order.

2. The liquid discharge head according to claim 1, wherein the partition portion is formed of silicon.

3. The liquid discharge head according to claim 1, wherein the second partition portion is formed of silicon.

4. The liquid discharge head according to claim 1, wherein the partition portion is longer than the liquid supply passage in a supply direction of the liquid.

5. The liquid discharge head according to claim 1, wherein the second partition portion is longer than the liquid collection passage in a supply direction of the liquid.

* * * * *